US005149899A

United States Patent [19]

Dabrowski

[11] Patent Number: 5,149,899

[45] Date of Patent: Sep. 22, 1992

[54] GUNSTOCK HAVING INTERCHANGEABLE COMBS

[75] Inventor: Gary Dabrowski, Naugatuck, Conn.

[73] Assignee: O.F. Mossberg & Sons, Inc., North Haven, Conn.

[21] Appl. No.: 781,969

[22] Filed: Oct. 24, 1991

[51] Int. Cl.[5] ..... F41C 23/14

[52] U.S. Cl. ..... 42/72

[58] Field of Search ..... 42/71.01, 72, 73, 74

[56] References Cited

U.S. PATENT DOCUMENTS

| | | | |
|---|---|---|---|
| 2,669,051 | 2/1954 | Cline | 42/71.01 |
| 3,710,496 | 1/1973 | Packmayr et al. | 42/73 |
| 4,055,016 | 10/1977 | Katsenes | 42/71.01 |
| 4,779,370 | 10/1988 | Cormack | 42/101 |

FOREIGN PATENT DOCUMENTS

| | | | |
|---|---|---|---|
| 1170937 | 1/1959 | France | 42/71.01 |
| 1500181 | 9/1967 | France | 42/73 |

*Primary Examiner*—Michael J. Carone

*Attorney, Agent, or Firm*—McCormick, Paulding & Huber

[57] ABSTRACT

A shotgun having interchangeable barrels includes a buttstock having interchangeable combs. A low comb is provided for use when the gun is fitted with a barrel having a sighting rib. A high comb may be used when the gun is fitted with a barrel for slug shooting with a scope. The selected comb is disposed within a notch in the buttstock and is secured by a single fastener.

19 Claims, 4 Drawing Sheets

GUNSTOCK HAVING INTERCHANGEABLE COMBS

BACKGROUND OF THE INVENTION

This invention relates in general to firearms and deals more particularly with an improved buttstock assembly for a firearm of the type having interchangeable barrels.

A gun fitted with a shot-shell barrel carrying a rib sight and having a conventional low-comb buttstock may be ideally suited for field shooting. However, the sighting requirements are entirely different when the same gun is fitted with a slug barrel and a telescopic sight or scope for hunting large game.

Heretofore, guns have been provided with interchangeable barrels having differing bore characteristics to satisfy various shooting requirements. One barrel may, for example, be particularly adapted for slug shooting with a scope whereas other barrel options may be more particularly suitable for field shooting.

It is the general aim of the present invention to provide an improved stock assembly which further enhances the versatility of a firearm of the aforedescribed type and affords the shooter optimum sighting positions to satisfy various shooting requirements imposed by various barrel options.

SUMMARY OF THE INVENTION

In accordance with the present invention a gunstock assembly having a buttstock including a butt having a heel, a forecomb forward of the butt, and a top surface extending forwardly from the heel to the forecomb includes an upwardly open notch between the heel and the forecomb. A plurality of combs of differing height are provided, each of the combs being shaped and sized to be received within and substantially fill the notch. An attaching means is provided for releasably retaining a selected one of the combs in assembly with butt stock within the notch.

DETAILED DESCRIPTION OF PREFERRED EMBODIMENT

Figure 1:
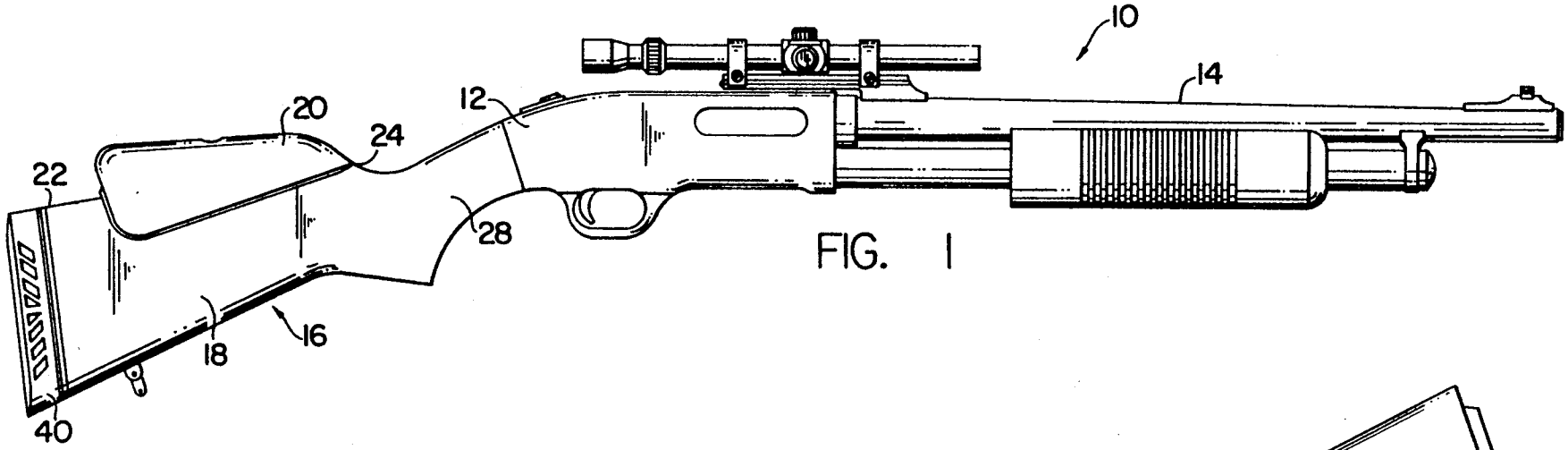
FIG. 1 is a side elevational view of a firearm having interchangeable barrels and including a gunstock assembly embodying the present invention and fitted with a high comb.

Turning now to the drawings and referring first particularly to FIG. 1, a shotgun of the interchangeable barrel type embodying the present invention is indicated generally by the reference numeral 10. The illustrated shotgun 10 is a Model 500 Trophy SLUGSTER manufactured by O. F. Mossberg & Sons, Inc., North Haven, Conn. 06473, assignee of the present invention, and includes a receiver 12, an interchangeable barrel 14 releasably secured to the receiver in a conventional manner, and a gunstock assembly, connected to and projecting rearwardly from the receiver and indicated generally by the numeral 16. The illustrated barrel 12, which is selected from a plurality of optional barrels, is a fully-rifled slug barrel particularly adapted for hunting large game. The stock assembly 16 includes a buttstock 18 modified to accommodate interchangeable combs of differing height and is shown fitted with a high comb 20, which provide the shooter with an optimum sighting position for scope shooting, all of which will be hereinafter more fully discussed.

Figure 2:
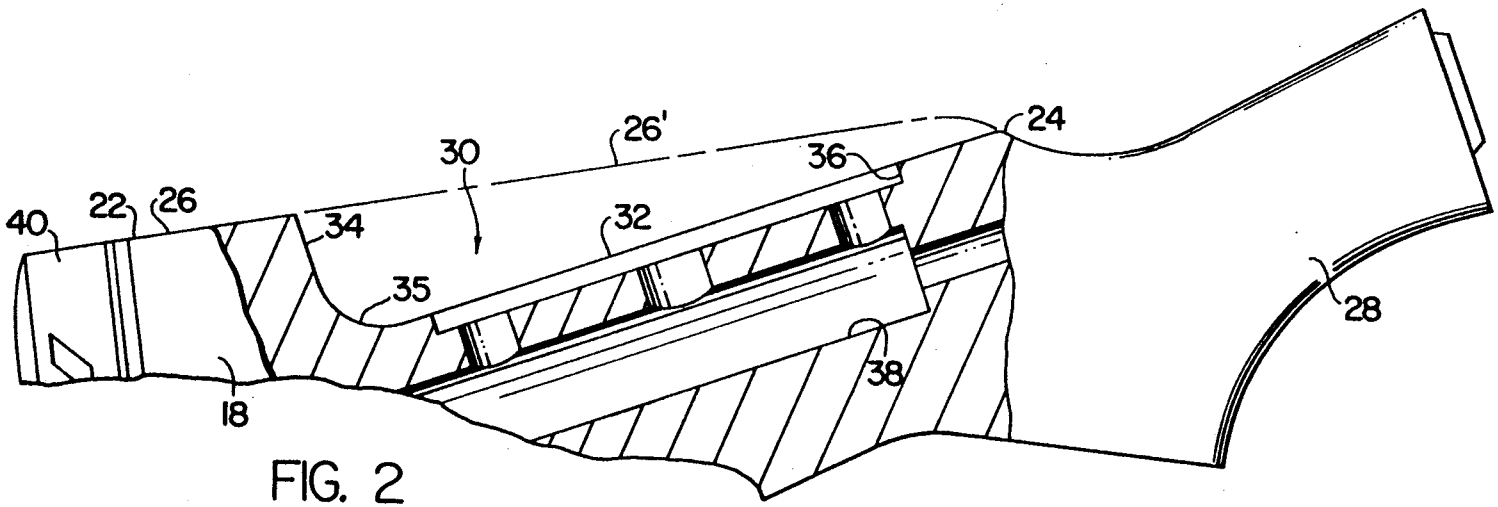
FIG. 2 is a somewhat enlarged fragmentary side elevational view of the buttstock shown in FIG. 1.

Considering now the gunstock assembly 16 in further detail, the buttstock may be made from any suitable material such as wood or plastic, but preferably, and as shown the buttstock 18 is made from wood and has a heel 22 and a forecomb 24 located forward of the heel and immediately rearward of a small or pistol grip portion indicated at 28. A top surface 26 extends forwardly of the heel in the direction of the forecomb 24 and in the unmodified form of the buttstock extends from the heel 22 to the forecomb 24. However, as previously noted, the buttstock 18 has been modified and includes an upwardly open notch between the heel and the forecomb, the latter notch being indicated generally at 30 and best shown in FIG. 2. Provision of the notch 30 results in removal of a portion of the top surface 26, the removed portion being indicated by broken lines 26' in FIG. 2. The notch 30 is preferably generally L-shaped, substantially as shown, and is defined by an upwardly facing surface 32 and a generally forwardly facing surface 34 and has a peripheral edge 35. A cavity 36 formed in the buttstock opens upwardly through the upwardly-facing surface 32, for a purpose which will be hereinafter further evident.

The illustrated buttstock 18 is particularly adapted for connection to the rear wall of the receiver 12 and has a countersunk bore 38 which extends through it for receiving a fastener (not shown) which threadably engages the rear wall of the receiver to retain the buttstock 18 in assembly with the receiver in a conventional manner well known in the gun art. The open end of the bore 38 is covered by a recoil pad 40 secured to the butt end of the buttstock 18.

Figure 3:
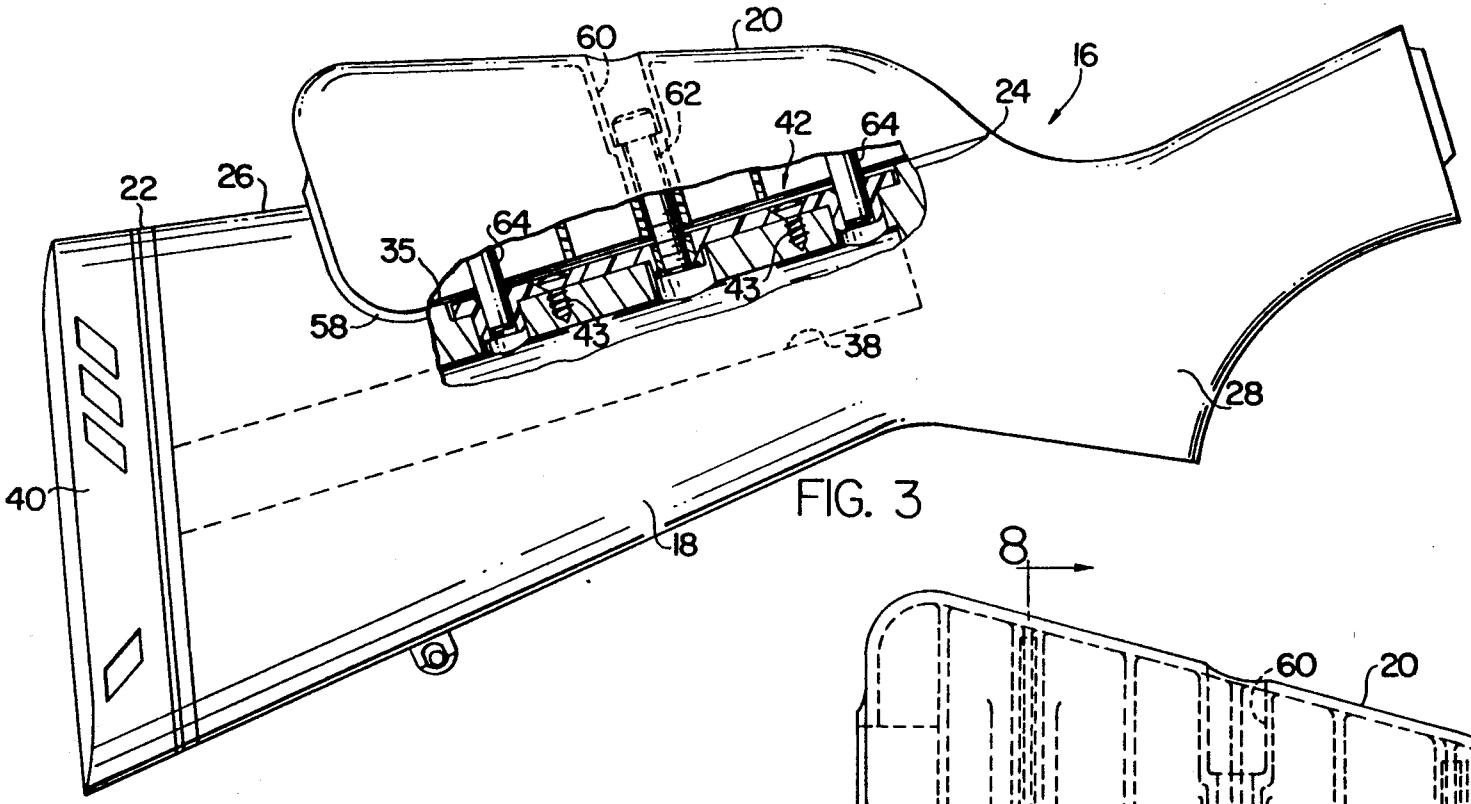
FIG. 3 is a somewhat enlarged side elevational view of the gunstock assembly of FIG. 1, portions of the assembly shown broken away to reveal internal structure.
Figure 4:
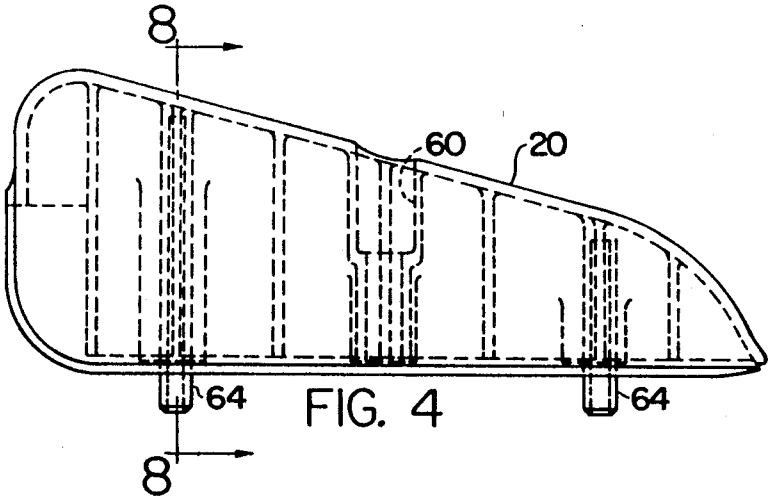
FIG. 4 is a side elevational view of the high comb shown in FIGS. 1 and 3.
Figure 5:
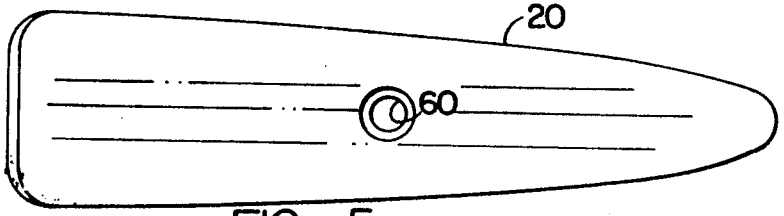
FIG. 5 is a top plan view of the comb shown in FIG. 4.
Figure 8:
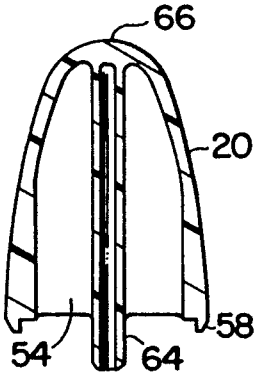
FIG. 8 is a sectional view taken generally along the line 8—8 of FIG. 4.
Figure 7:
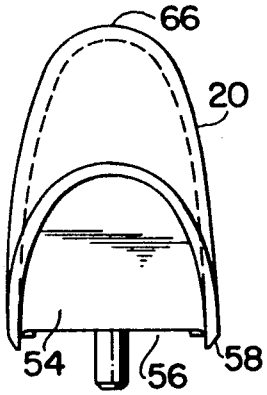
FIG. 7 is a rear end view of the high comb shown in FIG. 4.
Figure 12:
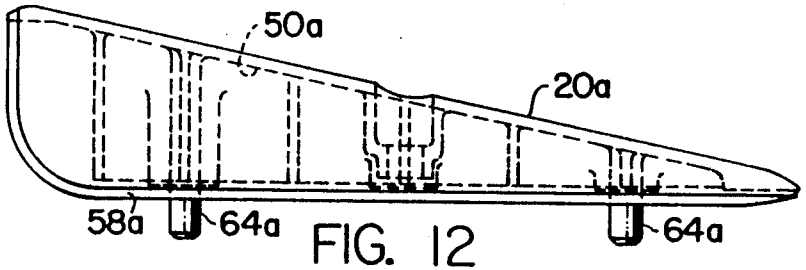
FIG. 12 is a side elevational view of the low comb shown in FIG. 11.
Figure 9:
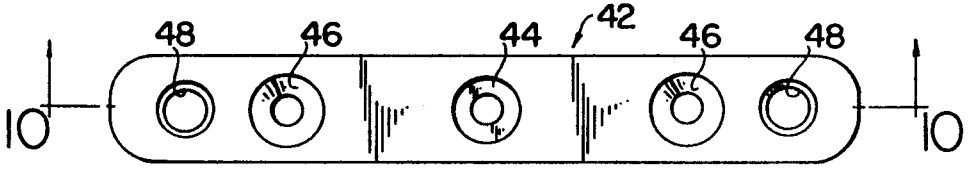
FIG. 9 is a somewhat enlarged plan view of an insert.
Figure 10:
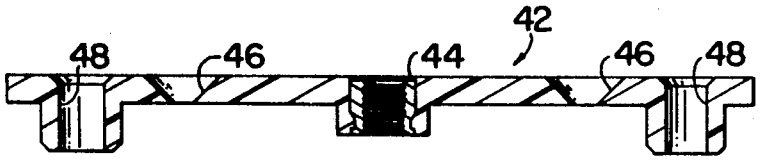
FIG. 10 is a sectional view taken along the line 10—10 of FIG. 9.

The illustrated buttstock 18 includes an insert indicated generally at 42 which is secured within the complimentary cavity 36 by screws 43,43. The insert, best shown in FIGS. 9 and 10 is preferably molded from durable plastic material and includes an integral threaded metal bushing 44 which is molded into and located centrally of the insert to define a fastener receiving opening. A pair of countersunk bores 46,46 extend through the insert 42 at opposite sides of the bushing for receiving screws which secure the insert to the buttstock within the cavity as shown in FIG. 3. The insert 42 further includes at least one locating hole 48, but preferably, and as shown, two locating holes 48,48 are provided and located at opposite ends of the insert outboard of the countersunk bores 46,46. If the buttstock is molded from plastic material the insert may be omitted and locating holes 46,46 and fastener receiving opening may be formed as an integral part of the buttstock.

Figure 6:
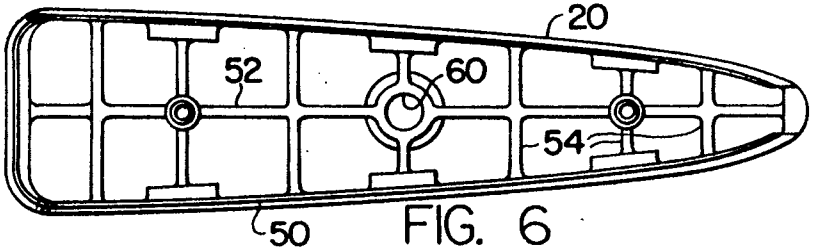
FIG. 6 is a bottom plan view of the comb shown in FIG. 4.

The high comb 20 illustrated in FIGS. 4–8 is selected from a plurality of combs of differing height, but is typical of the type of comb used with the modified buttstock 18. The comb 20 is preferably molded from a durable lightweight high impact plastic material such as RYNITE 415 HP and has a relatively thin walled outer shell 50. A plurality of stiffening ribs disposed within the outer shell 50 include a longitudinally extending rib 52 and a plurality of transversely extending ribs 54,54 which intersect the longitudinally extending rib 52, as best shown in FIG. 6.

The lower surface portions of the transversely extending ribs 54,54 lie within a common plane spaced upwardly from the lower edge of the outer shell 50 for seating engagement with the first surface 32. Thus, a shallow recess 56 is defined within the lower portion of the comb by a peripheral or skirt portion of the comb indicated at 58 and best shown in FIGS. 7 and 8. A countersunk bore 60 formed in a central portion of the comb 20 receives a threaded fastener 62 which secures the comb to the buttstock 18.

The comb carries at least one locating pin. However, the illustrated comb 20 is provided with two such pins 64 which are integrally formed on the comb and depend from it. The locating pins 64,64 preferably extend for some distance below the lower edge of the skirt 58 and are arranged for registration with the locating holes 48,48 in the insert 42.

The comb 20 is positioned in assembly with the buttstock 18 with the locating pins 64,64 disposed within the locating holes 48,48. The provision of two such pins which extend below the skirt 58 enables quick accurate positioning of the comb 20 on the buttstock 18. Assembly is completed by inserting the fastener 62 into the opening 60 and threadably engaging it with the bushing 44.

When the comb 20 is assembled with the buttstock 18 the peripheral edge portion or skirt 58 overlies an associated marginal portion of the buttstock 18 which partially defines the recess 56 and substantially conceals the peripheral edge of the associated marginal portion of the buttstock. The rear portion of the comb 20 substantially straddles an associated portion of the top surface 26, substantially as shown. The high comb 20 has an upper surface 66 disposed a substantial distance above the top surface 26. Thus, the high comb 20 provides a convenient rest surface for use in a firearm sighting mode when the firearm is fitted with a scope, as it appears in FIG. 1.

Figure 11:
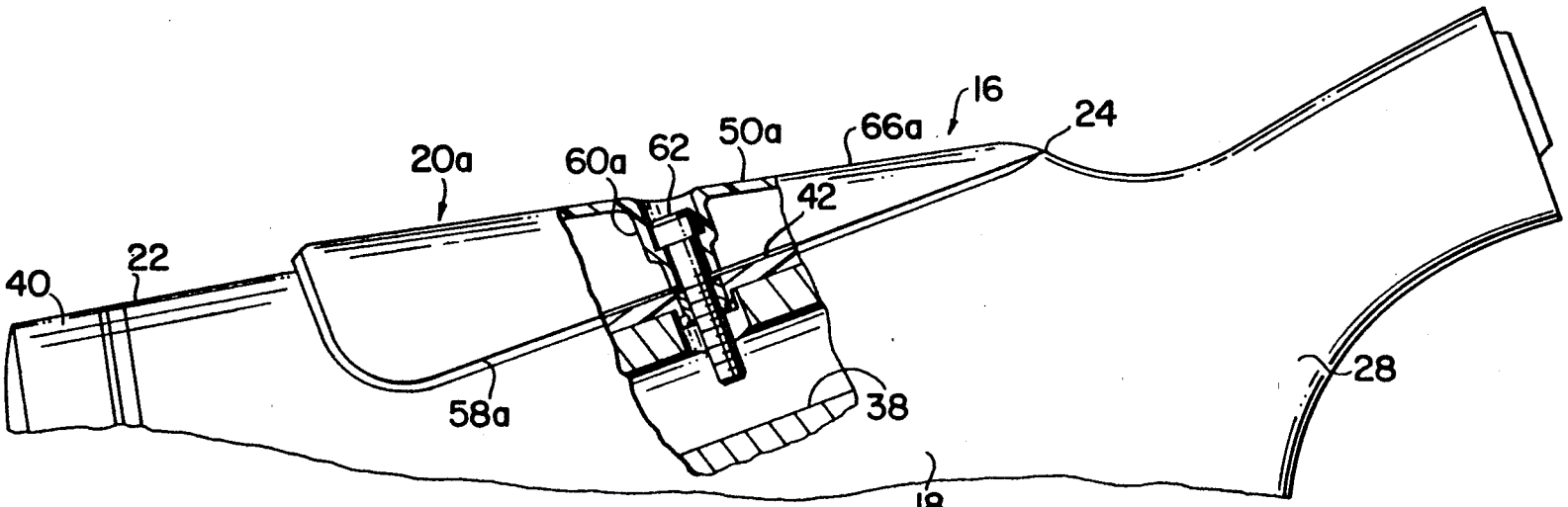
FIG. 11 is a fragmentary side elevational view similar to FIG. 3 but shows the buttstock fitted with a low comb.

Referring now to FIG. 11, the buttstock 18 is shown fitted with a low comb indicated generally at **20*a*. The comb 20*a* is substantially identical to the previously described comb 20 but has a different height dimension. Parts of the comb 20*a* which are substantially identical parts of the comb 20**, previously described, bear the same reference numeral as the previously described comb and a letter "a" suffix.

When the comb **20*a* is assembled with the stock 18 the upper surface of the comb, indicated at 66*a*, forms a generally co-extension of the top wall 26. The upper wall 66 terminates proximate the forestock 24, substantially as shown. The low comb 20 is particularly adapted for use when the gun 10** is fitted with a shotshell barrel having a sighting rib for use in field shooting.

I claim:

1. A gunstock assembly comprising a buttstock having a butt including a heel, said buttstock having a forecomb forward of said butt and a top surface extending forwardly from said heel and in the direction of said forecomb, said buttstock defining an upwardly open notch having a peripheral edge, a comb selected from a plurality of combs of differing height, each of said combs being shaped and sized to be seated upon said buttstock within said notch and substantially fill said notch, each of said combs having a peripheral skirt partially defining a recess for receiving an associated portion of said buttstock therein when said comb is assembled with said buttstock within said notch, said peripheral skirt overlying an associated marginal portion of said buttstock and substantially concealing said peripheral edge when said comb is assembly with said buttstock and attaching means for releasably retaining said comb in assembly with said buttstock within said notch.

2. A gunstock assembly as set forth in claim 1 wherein said one comb has an upper surface spaced a substantial distance above said top surface.

3. A gunstock assembly as set forth in claim 1 wherein said one comb has an upper surface forming a coextension of said top surface.

4. A gunstock assembly as set forth in claim 1 wherein said buttstock defines a cavity opening into said notch and said attaching means includes an insert received within said cavity and secured to said buttstock.

5. A gunstock assembly as set forth in claim 4 wherein said attaching means includes a single fastener passing through said one comb and connectably engaged with said insert.

6. A gunstock assembly as set forth in claim 5 wherein said insert includes a threaded bushing and said fastener is threadably engaged in said bushing.

7. A gunstock assembly as set forth in claim 1 including locating means for accurately positioning said comb in said notch and relative to said buttstock.

8. A gunstock assembly as set forth in claim 7 wherein said comb comprises a thin walled hollow shell having a plurality of stiffening ribs therein and said locating means comprises said stiffening ribs.

9. A gunstock assembly as set forth in claim 7 wherein said locating means includes at least one locating pin carried by said comb and received within a complementary opening in said buttstock.

10. A gunstock assembly as set forth in claim 9 wherein said locating means includes a pair of locating pins carried by said selected one comb.

11. A gunstock assembly as set forth in claim 10 wherein said assembly includes an insert mounted in said buttstock and defining two pin receiving openings and each of said locating pins is received in an associated one of said pin receiving openings.

12. A gunstock assembly as set forth in claim 9 wherein said buttstock has a cavity therein opening into said notch and said gunstock assembly includes an insert received within said notch and defining said opening in said buttstock.

13. A gunstock assembly as set forth in claim 1 wherein said buttstock is made from one material and said selected one comb is made from another material.

14. A gunstock assembly as set forth in claim 13 wherein said one material is wood and said other material is plastic.

15. A gunstock assembly comprising a buttstock having a butt including a heel, said buttstock having a forecomb forward of said butt and a top surface extending forwardly from said heel and in the direction of said forecomb, said buttstock defining a general L-shaped upwardly open notch between said heel and said forecomb and defined by a generally upwardly facing first surface and a generally forwardly facing second surface, said stock defining a cavity opening upwardly through said first surface, a mounting plate received and retaining in said cavity and defining at least one locating hole and at least one threaded mounting hole, a comb selected from a plurality of combs for assembly with said buttstock within said notch, each of said combs carrying at least one locating pin adapted to be received in said locating hole, each of said combs having at least one opening for alignment with said mounting hole to receive a threaded fastener engaged within said threaded mounting hole to retain said comb in assembly with said buttstock, each of said combs being contoured for positioning within said notch to substantially fill said notch, at least one of said combs including an upper surface having a substantial segment thereof spaced above said top surface when said one comb is assembled with said buttstock within said notch to provide a convenient rest surface for use in a firearm sighting mode.

16. A gunstock assembly as set forth in claim 15 wherein said mounting plate includes two locating holes and each of said combs has two locating pins for positioning in said locating holes.

17. A gunstock assembly as set forth in claim 15 wherein each of said combs comprises a substantially thin walled hollow shell containing a plurality of reinforcing ribs and at least two of said ribs are seated upon said buttstock when said comb is assembled with said buttstock.

18. A gunstock assembly as set forth in claim 17 wherein each of said combs has a peripheral skirt for overlying and concealing an associated peripheral edge of said notch when said comb is assembled with said buttstock.

19. In a firearm having a receiver, an interchangeable barrel selected from a plurality of barrels having differing bore characteristics, means for releasably securing the barrel to the receiver, a buttstock attached to and extending rearwardly from the receiver and having a butt including a heel, a forecomb forward of said butt, and a top surface extending forwardly from the heel in the direction of the forecomb, the improvement comprising said buttstock having a notch defined by a peripheral edge of said buttstock and opening upwardly through said top surface between said heel and said forecomb, a comb selected from a plurality of combs of differing height, each of said combs being shaped and sized to be received within and substantially fill said notch and having a peripheral skirt, and attaching means for releasably retaining a selected one of said combs in assembly with said buttstock within said notch, said peripheral skirt on said one comb substantially concealing said peripheral edge when said one comb is assembled with said buttstock.

* * * * *